US005143380A

United States Patent [19]

Maleski

[11] Patent Number: 5,143,380

[45] Date of Patent: Sep. 1, 1992

[54] BROADHEAD FOR AN ARROW

[76] Inventor: Richard Maleski, 4 South Street, Plymouth, Conn. 06782

[21] Appl. No.: 637,464

[22] Filed: Jan. 4, 1991

[51] Int. Cl.[5] ..... F42B 6/08

[52] U.S. Cl. ..... 273/422; 273/416

[58] Field of Search ..... 273/416, 419–422; D22/115; 43/6

[56] References Cited

U.S. PATENT DOCUMENTS

| | | | |
|---|---|---|---|
| 232,731 | 9/1974 | Altier | D22/115 |
| D. 310,553 | 9/1990 | Kania et al. | D22/115 |
| D. 314,416 | 2/1991 | Rezmer | D22/115 |
| 2,350,581 | 6/1944 | Boose | 273/421 |
| 2,989,310 | 6/1961 | Lamond | 273/416 |
| 3,282,262 | 11/1966 | Skinner | 273/416 X |
| 3,859,728 | 1/1975 | Shutt | 273/421 X |
| 3,897,062 | 7/1975 | Christensen | 273/421 |
| 4,166,619 | 9/1979 | Bergmann et al. | 273/421 X |
| 4,268,038 | 5/1981 | Wierenga | 273/416 |
| 4,380,340 | 4/1983 | Simo | 273/416 |
| 4,381,866 | 5/1983 | Simo | 273/422 |
| 4,452,460 | 6/1984 | Adams | 273/422 |
| 4,505,482 | 3/1985 | Martin, Sr. | 273/421 |
| 4,558,868 | 12/1985 | Musacchia | 273/422 |
| 4,615,529 | 10/1986 | Vocal | 273/421 |
| 4,651,999 | 3/1987 | Sturm | 273/416 |
| 4,772,029 | 9/1988 | Watkins | 273/416 |
| 4,905,397 | 3/1990 | Juelg, Jr. | 43/6 |
| 4,940,245 | 7/1990 | Bittle, Jr. | 273/416 |

OTHER PUBLICATIONS

Turkey Buster Advertising Circular 2–1987.

*Primary Examiner*—Paul E. Shapiro

*Attorney, Agent, or Firm*—Dilworth & Barrese

[57] ABSTRACT

A broadhead for an arrow having penetration limiting members positioned thereon for limiting the penetration of the arrow and broadhead through a target. The penetration limiting members are assembled to the broadhead in much the same way as the blades of the arrow, and have a substantially triangular shape in which a first leg is attached to the broadhead and a second leg extends at an angle from the first leg. A portion of a third leg is provided which assists in the initial penetration to allow the broadhead to enter the target.

20 Claims, 2 Drawing Sheets

BROADHEAD FOR AN ARROW

BACKGROUND OF THE INVENTION

1. Field of the Invention

The present invention relates to broadheads for use in bow hunting, and more particularly, to a broadhead having means for limiting penetration of the broadhead and arrow into an animal during hunting.

2. Discussion of the Prior Art

Broadheads for arrows having penetration limiting or arresting mechanisms to limit the penetration of the arrow through an animal are well known in the art. These arrows typically include a hook-type mechanism which engages the hide or skin of the animal upon impact and slows the penetration of the arrow through the animal due to the force or speed of the arrow. These arrows may also include means for tethering the arrow to the animal in the event the arrow passes through the animal's body.

Various broadheads having means to increase the diameter of the path of the arrow once it hits the animal's body are provided in the prior art, which in turn act as a means for limiting or slowing the penetration of the arrow through the animal. These devices are generally provided to create a greater destructive path upon impact, to insure that the strike will be a fatal one.

A concern among hunters, particularly hunters tracking birds or small game, is that an arrow impacting with an animal at high speed will tend to pass directly through the animal, allowing the animal to escape. A particular concern is that the thus wounded animal will then slowly bleed to death over a period of days, often enduring a very painful demise Accordingly, it is important that the strike be a fatal one, preferably with the arrow remaining secured to the animal to prevent loss of the arrow.

Consequently, numerous attempts have been made to provide a means for securing the arrow to the animals body upon impact, to prevent the arrow from passing directly through the animal's body. In response to this need, several prior art broadheads provide complex pivoting or spring action mechanisms which activate upon impact to create an extensive damage path and to further imbed the arrow into the animal's body. A typical arrow having a pivoting mechanism attached to the broadhead is disclosed in U.S. Pat. No. 4,615,529 to Vocal, which provides a hook mechanism at the rear of the arrow for snagging the animal and causing the pivoting members of the broadhead to open outwardly to imbed the arrow in the animal.

A similar arrow having pivotable arms at the broadhead is disclosed in U.S. Pat. No. 4,166,619 to Bergmann et al., which provides an arrow head having a pair of movable blades which pivot outwardly upon impact to cause significant bleeding. A similar type device is disclosed in U.S. Pat. No. 4,452,460 to Adams.

U.S. Pat. No. 4,651,999 to Sturm discloses a hooked catching device which loops about the shaft of the arrow and is attached to a string or line positioned within the hollow arrow shaft. As the arrow passes into the animal, the hook mechanism catches the animal's hide or skin and tethers the arrow to the body in the event the arrow passes through the animal. A similar type device is disclosed in U.S. Pat. No. 2,989,310 to Lamond which provides a clip-on penetration limiter which engages the hide of the animal upon impact and slides down the arrow shaft where it catches the fletching at the rear of the arrow to stop further penetration of the arrow.

A significant disadvantage of the devices of the prior art which are attached to the arrow shaft lies in the fact that the aerodynamics of such a device significantly effects the flight of the arrow and in many cases will result in a miss which can lead to a lost arrow for the hunter. As the arrow spins during flight, the increased weight at the arrow head, which in many cases is not symmetrically balanced about the broadhead, causes the arrow to rotate or spin non-symmetrically causing the arrow to veer off target and miss the animal.

Another disadvantage of the prior art broadheads which provide a string or tether line which tethers the arrow to the animal in the event the arrow passes through the animal is that the string or line may break, or the animal may simply drag the arrow by the string and escape.

Disadvantages associated with the pivoting blades and pivoting stop mechanisms include premature opening which affects accuracy and penetration, in addition to increased cost during manufacture to provide the complex pivoting mechanisms.

The novel broadhead having penetration limiting means formed as part of the broadhead of the present invention obviates the disadvantages encountered in the prior art and provides an efficient penetration device for preventing the arrow from passing through the body of the target animal. Furthermore, the broadhead of the present invention is aerodynamically balanced to provide a true and accurate flight, and further is simple and inexpensive to manufacture.

SUMMARY OF THE INVENTION

The present invention provides a novel broadhead for an arrow which limits the penetration of the arrow through a target without affecting the aerodynamics and accuracy of the arrow during flight. A plurality of penetration limiting members are provided on the broadhead which are similar in shape and dimension to the blades of the arrow and therefore provide a balanced broadhead for the arrow. The penetration limiting members are assembled to the broadhead in the same manner as the blades are assembled, so the resulting broadhead is simple to manufacture and assemble, while maintaining a manufacturing cost similar to a conventional broadhead.

The broadhead of the present invention essentially comprises a conventional broadhead having a pointed tip at one end and means for securing the broadhead to an arrow at the other. A plurality of blades are assembled in slots about the body of the broadhead, and a plurality of penetration limiting members are provided in slots about the body of the broadhead in between adjacent blades. The slots provided for the penetration limiting members are identical to the slots provided for the blades, and the penetration limiting members are assembled about the body of the broadhead in much the same way as the blades. Any number of blades may be used, and it is contemplated that at least one penetration limiting member be provided. Preferably, three blades are used, and three penetration limiting members are provided, with alternating blades and penetration limiting members being positioned about the body.

The penetration limiting members of the present invention are substantially triangular in shape, and have similar dimensions to the blades used with the broadhead. Conventional blades are triangular in shape, where a first leg is connected to a second leg through an acute angle, and the third leg is connected to the second leg, and to the first leg.

In order to maintain balance and stability during flight, and to maintain the aerodynamic properties of the broadhead and arrow, the penetration limiting members of the present invention are substantially triangular in shape having an elongated first leg which is attached to the body of the broadhead. A second leg extends from the first leg at an acute angle, the angle being similar to that at the second leg of the blade. Only a portion of a third leg is provided, which extends towards the first leg at an angle, which again is similar to the angle at which the third leg, or razor sharpened leg of a conventional blade, extends. It is the upstanding second leg and portion of the third leg which limits the penetration of the broadhead through the target animal upon impact.

Alternately, the second leg may extend from the first leg at a right angle, in a direction perpendicular to the first leg. The third leg then extends back to the first leg at an acute angle, and again it is the second leg and third leg which provide the penetration limiting feature of the broadhead. In a further embodiment, the third leg may be provided with a barbed tip, which prevents the arrow from shaking loose or backing out of the wound. Furthermore, while it has been described above that the blades and penetration limiting members are secured to the broadhead in slots, any mounting means is acceptable, as long as the angle between the first leg and the second leg is no greater than 90° in order that the penetration limiting members are forwardly directed to limit penetration of the broadhead through the target animal.

BRIEF DESCRIPTION OF THE DRAWINGS

The foregoing features of the present invention will become more readily apparent and may be understood by referring to the following detailed description of an illustrative embodiment of the broadhead of the present invention and its novel penetration limiting feature, taken in conjunction with the accompanying drawings, in which.

DETAILED DESCRIPTION OF THE PREFERRED EMBODIMENTS

Figure 1:
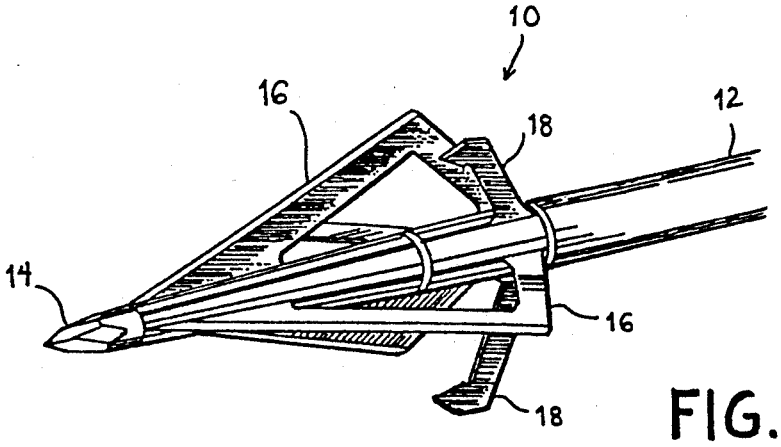
FIG. 1 illustrates a perspective view of the broadhead of the present invention.

Referring now in specific detail to the drawings, in which like reference numerals identify similar or identical elements throughout the several views, FIG. 1 shows the broadhead 10 of the present invention. Broadhead 10 is attached to arrow shaft 12 in a conventional manner, and includes a pointed tip 14, blades 16, and the novel penetration limiting members 18 of the present invention. Penetration limiting members 18 are forwardly directed, and are positioned between adjacent blades 16 as shown.

Figure 2:
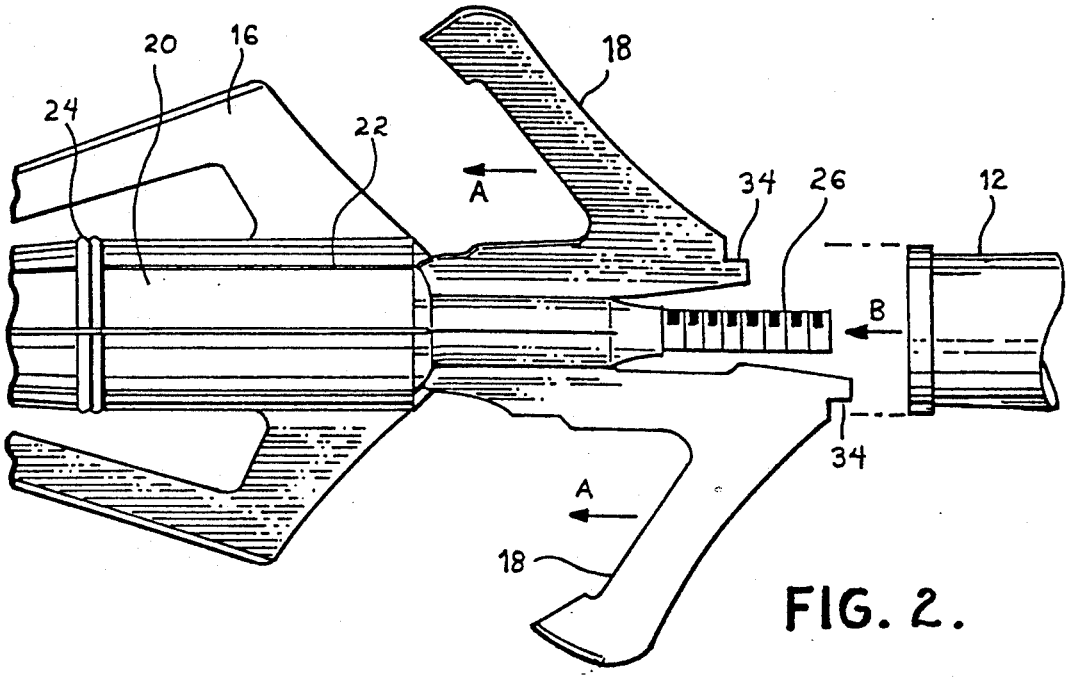
FIG. 2 illustrates a side plan and exploded view of the broadhead of the present invention.

FIG. 2 illustrates the assembly of the broadhead 10 in which blades 16 and penetration limiting members 18 are assembled to body portion 20. Body portion 20 is provided with a plurality of slots 22 into which blade members 16 are fitted along with penetration limiting members 18 in an alternating arrangement. While any conventional means may be used to secure blades 16 and penetration limiting members 18 to body member 20, it is preferred that a split lock or snap ring 24 be provided to lock the blades and penetration limiting members in place. Such a locking mechanism is described in U.S. Pat. No. 4,169,597 which is incorporated herein by reference.

Blades 16 and penetration limiting members 18 are positioned in slots 22 of body member 20 as shown in FIG. 2, where penetration limiting members 18 are assembled in the direction arrow A until they are in place adjacent blades 16. Broadhead 10 is then secured to arrow 12 in a conventional manner, as shown for example in FIG. 2 by means of threads 26 which allow the broadhead to be screwed into a threaded bore in arrow 12 as shown by the direction of arrow B. Broadhead 10 may be secured directly to arrow 12, or through the provision of an adapter member (not shown).

Figure 3:
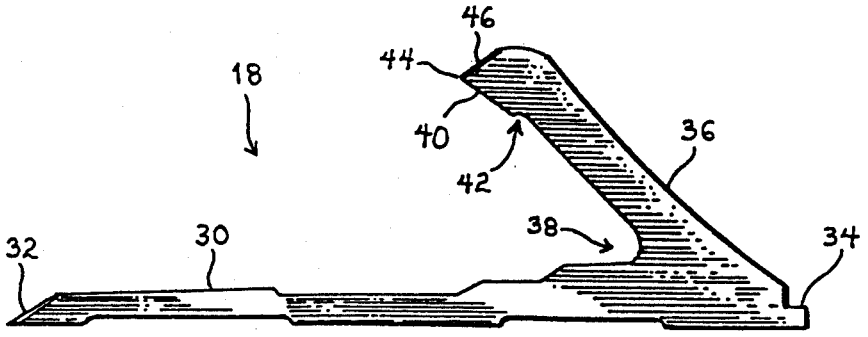
FIG. 3 illustrates a side plan view of a penetration limiting member of the present invention.

FIG. 3 illustrates the penetration limiting member 18 of the present invention. Member 18 comprises a first elongated leg 30 which is constructed to slide into slot 22 on body member 20. A forward portion 32 of leg 30 has a tapered shape to allow leg 30 to be positioned under a trailing edge of pointed tip 14 to secure the front edge of penetration limiting member 18 in place. The opposite end 34 of leg 30 has a notched portion which fits under the leading edge of arrow 12 (or an adapter member if one is used) to secure the rear end of penetration limiting member 18. This can best be seen in FIG. 2.

A second leg 36 is provided which extends from first leg 30 at an acute angle 38. Angle 38 is similar to the angle at which the second leg of blade 16 extends from body member 20. Preferably, angle 38 is an acute angle between 15° and 90° and in the preferred embodiment is approximately 45°. Angle 38 causes leg 36 to be forwardly directed, so that penetration of the broadhead 10 through a target animal is limited.

Extending from leg 36 is a portion of a third leg 40 which extends from leg 36 at an angle 42. Leg 40 maintains the substantially triangular shape of penetration limiting member 18, and the angle 42 between legs 40 and 36 will of course be determined by the length of legs 30 and 36 and the angle 38 between them. Leg 40 is provided with a pointed tip 44 and a sharpened edge 46, which allow for penetration upon initial contact to insure the broadhead passes through the skin or hide of the animal. Leg 36 then limits penetration of the broadhead 10 through the animal.

Figure 4:
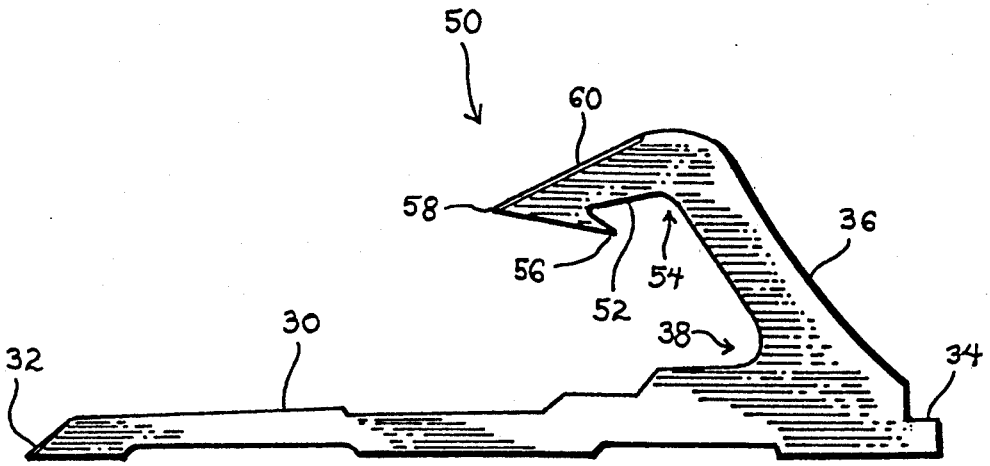
FIG. 4 illustrates a side plan view of an alternate embodiment of the penetration limiting member of FIG. 3.

FIG. 4 illustrates an alternate penetration limiting member 50 of the present invention. Penetration limiting member 50 is identical to member 18 of FIG. 3 except for third leg 52. Third leg 52 extends from second leg 36 at an angle 54, which of course is determined by the length of legs 30 and 36 and the angle 38 between them. Third leg 52 is provided with a barbed member 56, which prevents backing off of the broadhead and arrow after a strike in the event the broadhead only partially penetrates the target. Pointed tip 58 and razor edge 60 allow for initial penetration in much the same manner as described with reference to FIG. 3.

Figure 5:
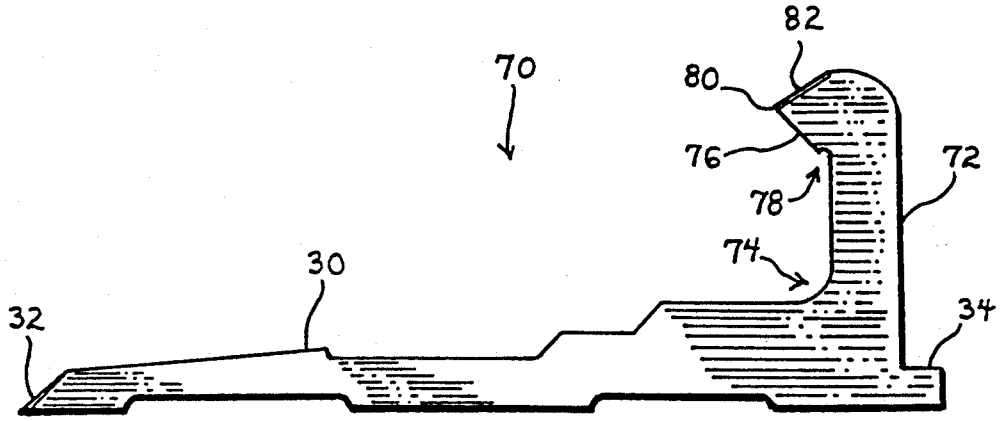
FIG. 5 illustrates a side plan view of a further alternate embodiment of the penetration limiting member of FIG. 3.

FIG. 5 illustrates a further embodiment of the penetration limiting member 70 of the present invention. Member 70 is identical to members 18 and 50 described above, except that second leg 72 extends from first leg 30 at an angle 74 which is substantially a right angle or 90° angle. Leg 72 is substantially perpendicular to leg 30. A third leg 76 is provided which extends at an angle 78 which again is determined by the length of legs 30 and 72 and angle 74 between them. Pointed tip 80 and razor edge 82 serve the same purpose as that described above with reference to the embodiments in FIGS. 3 and 4.

While the invention has been particularly shown and described with reference to the preferred embodiments, it will be understood by those skilled in the art that various modifications and changes in form and detail may be made therein without departing from the scope and spirit of the invention. In particular, the angle between the first and second legs of the penetration limiting members may be any acute angle up to and including a 90° angle, in order to sufficiently limit penetration of the broadhead through a target animal. Accordingly, modifications such as those suggested above, but not limited thereto, are to be considered within the scope of the invention.

What is claimed is:

1. A broadhead for an arrow comprising:

a body member having a pointed tip end and a shaft securement end;

a plurality of blades attached to said body member; and at least one penetration limiting member attached to said body member and positioned between at least two of said blades;

wherein said penetration limiting member comprises a first leg attached to said body member and a second leg having one end attached to said first leg and extending at an angle to said first leg towards said pointed tip end and having a second end positioned at a distance from said first leg to define a gap between said second end and said body member.

2. A broadhead according to claim 1, wherein a penetration limiting member is positioned between each of said blades on said body member.

3. A broadhead according to claim 1, wherein said penetration limiting member comprises a forwardly directed hook member.

4. A broadhead according to claim 3, wherein said hook member extends a distance from said body member which is approximately the same as a distance an outermost tip of said blades extends from said body member.

5. A broadhead according to claim 1, wherein said blades and said penetration limiting members are secured in grooves on said body member.

6. A broadhead according to claim 1, wherein said blades are triangular in shape and said penetration limiting member has substantially the same shape as said blades.

7. A broadhead according to claim 6, wherein said triangular shape of said blades and said substantially triangular shape of said penetration limiting member cooperate to reduce wind resistance and increase aerodynamic accuracy of said broadhead during flight of said arrow.

8. A broadhead according to claim 1, wherein said first leg is attached to said body member and said second leg is positioned at an acute angle to said first leg.

9. A broadhead according to claim 1, wherein said penetration limiting member comprises a first leg attached to said body member and a second leg positioned at a right angle to said first leg.

10. A broadhead according to claim 1, wherein said penetration limiting member comprises a first leg attached to said body member, a second leg extending from said first leg at an acute angle, and a portion of a third leg extending from said second leg, said penetration limiting member having a substantially triangular shape.

11. A broadhead according to claim 10, wherein said portion of said third leg extends toward said pointed tip of said arrow.

12. A penetration limiting broadhead for an arrow, said broadhead including a body member, a plurality of triangular shaped blades attached to said body member, and a pointed tip, said body member being secured to a shaft of said arrow, said broadhead comprising:

at least one substantially triangular shaped penetration limiting member, said member having a first leg connected to said body member, a second leg extending from said first leg at an acute angle, and a portion of a third leg extending from said second leg, wherein said portion of said third leg extends toward said pointed tip.

13. A broadhead according to claim 12., wherein said penetration limiting member is positioned on said body member between at least two of said blades.

14. A broadhead according to claim 12, wherein said blades and said penetration limiting member have substantially the same shape.

15. A broadhead according to claim 12, wherein said blades/ correspond in number to said penetration limiting members, such that said blades and said members alternate in position about the circumference of said body member.

16. A broadhead according to claim 12, wherein said blades and said penetration limiting members are secured in slots in said body member.

17. A device according to claim 16, wherein said second leg extends from said first leg at a right angle.

18. A device according to claim 16, wherein said third leg is provided with a barb-like projection.

19. A penetration limiting device for a broadhead comprising a first leg secured to said broadhead, a second leg extending from said first leg at an angle, and a portion of a third leg extending from said second leg at an angle towards said first leg, said third leg being positioned in a direction toward a tip of said broadhead.

20. A device according to claim 19 wherein said second leg extends from said first leg at an acute angle.

* * * * *